US005443364A

United States Patent [19]

Mistry et al.

[11] Patent Number: 5,443,364

[45] Date of Patent: Aug. 22, 1995

[54] SNAP-FIT INDUCER HOUSING AND COVER FOR GAS FURNACE

[75] Inventors: Mayank C. Mistry, Indianapolis; Timothy J. Waterman, Carmel; Michael J. Larsen, Danville, all of Ind.

[73] Assignee: Carrier Corporation, Syracuse, N.Y.

[21] Appl. No.: 137,719

[22] Filed: Oct. 18, 1993

[51] Int. Cl.[6] ..... F01D 21/14

[52] U.S. Cl. ..... 415/214.1; 403/326

[58] Field of Search ..... 415/214.1, 206; 403/326, 321

[56] References Cited

U.S. PATENT DOCUMENTS

| | | | |
|---|---|---|---|
| 2,963,979 | 12/1960 | Eisenmann et al. | 415/200 |
| 4,599,042 | 7/1986 | Collivor | 415/214.1 |
| 4,997,342 | 3/1991 | Conger, IV | 415/214.1 |
| 5,042,269 | 8/1991 | Sullivan | 415/214.1 |
| 5,120,193 | 6/1992 | Kadle et al. | 415/206 |
| 5,141,397 | 8/1992 | Sullivan | 415/214.1 |
| 5,257,904 | 11/1993 | Sullivan | 415/214.1 |

*Primary Examiner*—John T. Kwon

[57] ABSTRACT

An improved inducer for a gas furnace having a housing and cover includes a number of radially extending tabs spaced around the inducer cover. Each of the tabs has an aperture formed therein. The inducer housing is provided with a number of flexible arms including a barbed detent at the distal end of each arm. The flexible arms are spaced around the outside of a side wall of the housing, fabricated from the same material as the housing, and correspond in number and placement to the tabs on the cover. A sealing channel with a gasket provided therein is formed on the interior side of the cover. The sealing channel corresponds in shape to the top edge of the housing side wall. When the channel gasket is placed in contact with the top edge of the wall and each respective barbed detent within a corresponding tab aperture, a force exerted against the housing and cover will cause the arms to bend slightly and the detents to snap into the tab aperture thereby securing the cover to the housing.

6 Claims, 4 Drawing Sheets

SNAP-FIT INDUCER HOUSING AND COVER FOR GAS FURNACE

BACKGROUND OF THE INVENTION

1. Field of the Invention

This invention relates in general to gas furnaces and, in particular, to an inducer utilized to aid the flow of flue gas through the heat exchanger cells of a gas furnace. More specifically, but without restriction to the particular embodiment hereinafter shown and described, this invention relates to a snap and lock feature allowing expedited assembly of the inducer cover and housing.

2. Discussion of the Background Art

Gas furnaces typically include a primary heat exchanger positioned adjacent a burner box containing burners. During operation of the furnace, a blower moves circulating air over the heat exchanger to produce heated air that is directed to a desired location. Gas is supplied to the burner box by a gas manifold having orifices that direct the gas into the burners. The gas exiting the burners is ignited by an ignitor provided in the burner box. The burners allow combustion of the gas as well as direct heated flue gas into the heat exchanger. The typical heat exchanger includes cells with a channel or pass formed in each cell to direct the flow of flue gas produced by combustion. These cells are positioned side by side in a parallel manner and are provided with a predetermined spacing to allow the blower air to flow around the cells. The blower air is thus heated by convection as it circulates over the cells.

A sheet metal panel or cell panel having burner target plates is typically provided to position the burner box relative to the inlet side of the cells contained in the heat exchanger. An inducer having a motor and fan is typically mounted on the discharge side of the heat exchanger. The inducer is activated to induce a flow of flue gas through the heat exchanger and into vent piping so that the flue gas may be vented to a location exterior to the furnace.

The residential heating industry has advanced with the advent of condensing gas furnaces. These furnaces typically included a primary heat exchanger as well as a condensing heat exchanger. A blower in these condensing furnaces similarly provides circulating air flow over both heat exchangers to produce heated air that may be directed to a desired location by a system of duct work and registers.

In such condensing furnaces, both the primary heat exchanger and the condensing heat exchanger include cells with a channel or pass formed therein to direct the flow of flue gas produced by combustion. These cells in both the primary and secondary heat exchangers are positioned side by side in a parallel manner and are provided with a predetermined spacing to allow blower air to flow around both groups of heat exchanger cells. Gas is similarly provided to the condensing furnace by a gas manifold having orifices that direct the gas into burners contained in a burner box. The burner box is secured to the inlet side of the primary heat exchanger to align the discharge end of the burners with the inlet ports of the primary heat exchanger cells. The gas is ignited by an ignitor as it exits the burners contained in the burner box. The heated flue gas produced by combustion is then directed into the primary heat exchanger cells.

The condensing heat exchanger of the furnace is configured in a similar manner to its primary heat exchanger. A series of side by side condensing cells is provided. Each of these condensing cells has an inlet port for receiving flue gas discharged from the primary heat exchanger. The inlet ports of the condensing heat exchanger cells are aligned and secured in a sheet metal panel forming the inlet side of the condensing heat exchanger. The inlet side of the condensing heat exchanger is fluidly connected to the discharge side of the primary heat exchanger by a coupling box. The condensing cells function to exchange heat with the clean circulation air and to condense water vapor out of the products of combustion contained in the flue gas. This condensate drains from the condensing cells into a collector box provided on the discharge side of the condensing heat exchanger. The collector box extends through the cell panel below the burner box and includes tubing to further drain the condensate from the box into drain piping. The collector box is provided with an opening to which the intake side of an inducer in fluidly secured. The inducer in the condensing furnace induces the flow of heated flue gas through the cells in both the primary and condensing heat exchangers.

With recent advancements in the art, a commercially feasible condensing gas furnace having four possible installation orientations has been proposed by the assignee of the present invention. Such gas-fired furnaces are known in the art as multi-poise condensing furnaces and are disclosed, for example, in the co-pending, commonly assigned U.S. patent application Ser. No. 08/089697, entitled "Multi-Poised Condensing Furnace". These multi-poise furnaces are installable with either an upflow, downflow, horizontalright flow, or horizontal- left flow orientation. They include design features which allow the furnace to function properly and just as efficiently in any one of these four possible installation orientations. One such feature results in proper drainage of condensate from the condensing heat exchanger cells into the collector box irrespective of the selected installation orientation. As another example, the inducer, employed to accommodate the multi-poise furnace, features two optional discharge ports. Depending on the installation orientation, one of the two inducer discharge ports is selected to be connected to the vent piping while the other unused port is capped with an air-tight seal.

All of the above discussed furnaces typically rely on an inducer for proper operation. The typical inducer includes a housing provided with an intake port that is fluidly connected to the discharge side of a heat exchanger and a discharge port for venting the flue gas. The inducer also includes a cover having a motor mounted on one side with a shaft extending through the cover to the other side. The end of the motor shaft is supplied with a circular fan. The cover is typically secured to the housing by screws. This manner for assembling together the inducer housing and cover is relatively expensive, requires a relatively long period of assembly time, and may result in uneven or excessive pressure around a sealing gasket provided between the housing and cover.

OBJECTS AND SUMMARY OF THE INVENTION

It is, therefore, an object of the present invention to improve gas furnaces.

It is a further object of the present invention to utilize a high strength and resilient material to form an inducer housing and cover for a gas furnace, the housing and cover including fasteners integrally formed thereon to allow quick and secure assembly.

Still a further object of the present invention is to reduce the time required to assemble the inducer housing and cover of an inducer employed in a gas furnace to induce the flow of flue gas through heat exchanger cells.

An additional object of the present invention is to maintain even pressure on a gasket provided between the cover and the housing of an inducer employed in a gas furnace so as to preserve a durable seal between the cover and housing.

Yet another object of the present invention is to reduce the cost of the fasteners used to secure the cover to the housing of an inducer employed in a gas furnace to induce the flow of flue gas through heat exchanger cells.

These and other objects are attained in accordance with the present invention wherein there is provided a plurality of outwardly extended tabs positioned around the periphery of an inducer cover. Each of the tabs has an aperture formed therein. The inducer cover has an interior side which is provided with an endless channel having a sealing gasket situated therein. In accordance with another aspect of the invention, a plurality of flexible arms is provided around the side wall of an inducer housing, each of the arms corresponding to one of the tabs on the inducer cover. The distal end of each arm is provided with a barbed detent receivable within a corresponding tab aperture while the gasket channel corresponds in shape to the top edge of the housing side wall. When the cover is positioned with the sealing gasket in contact with the top edge of the side wall of the housing and a barbed detent positioned within a corresponding tab aperture, the housing and cover may be securely snapped together.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing with like reference numerals indicating like components throughout, wherein.

DETAILED DESCRIPTION OF A PREFERRED EMBODIMENT

Figure 1:
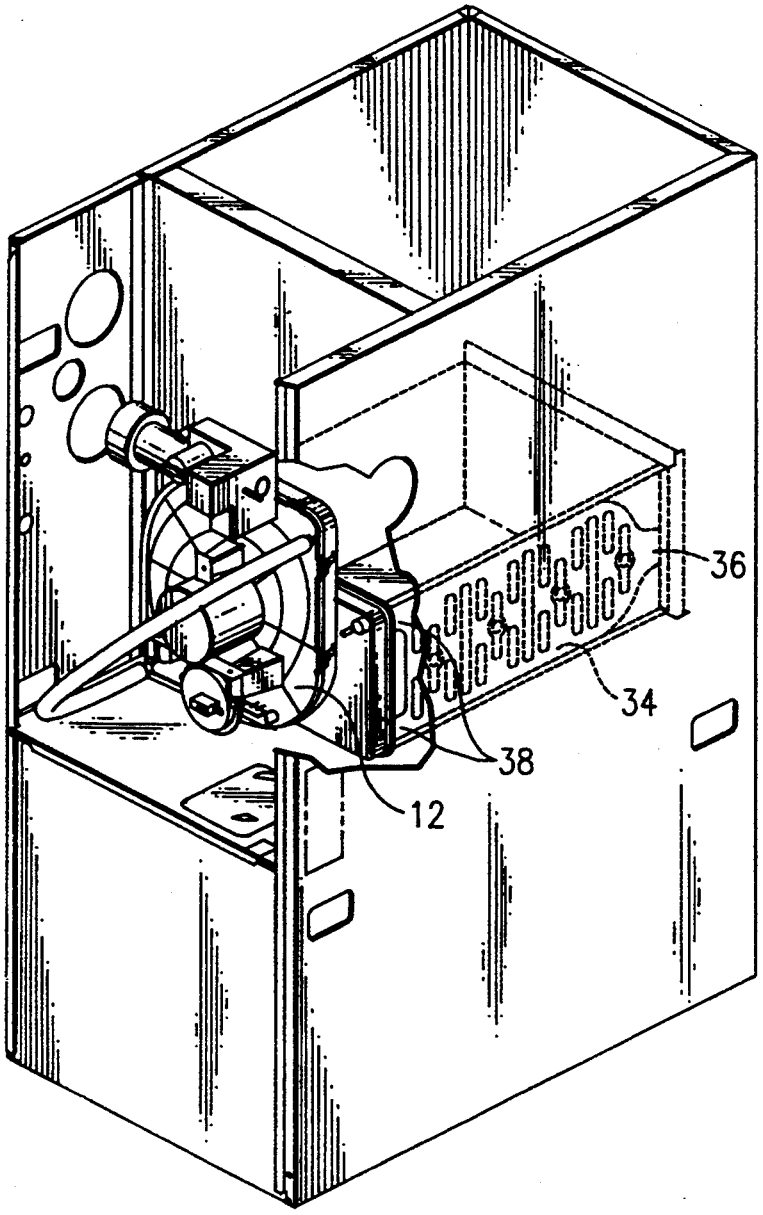
FIG. 1 is a partially cut-away perspective view of a multi-poise furnace incorporating an inducer in accordance with the present invention.
Figure 2:
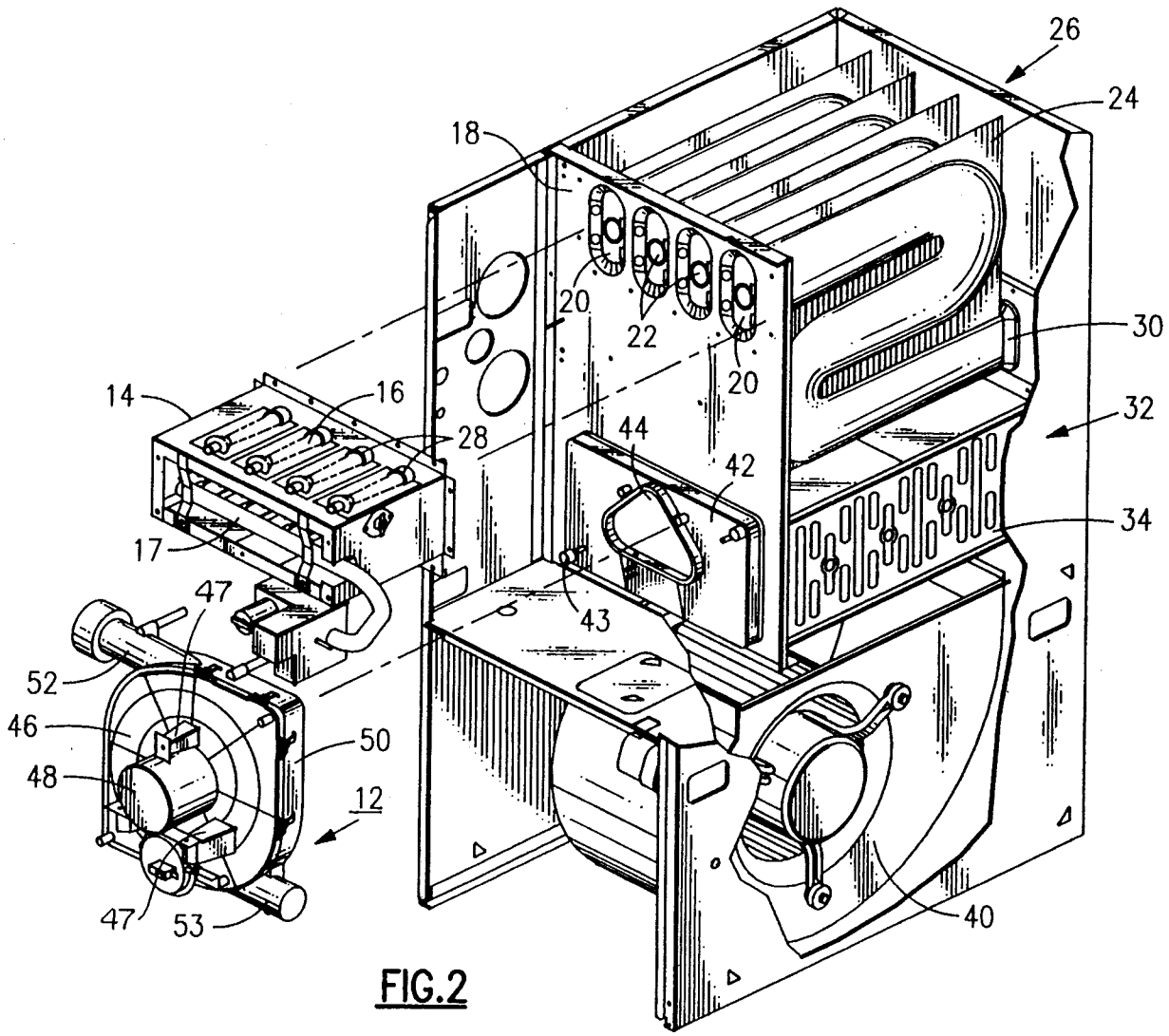
FIG. 2 is a cut-away and partially exploded perspective view of the furnace of FIG. 1.

Referring now to the drawing and initially to FIGS. 1 and 2, there is shown a multi-poise condensing gas furnace 10 having an inducer 12 in accordance with the present invention. The inducer 12 is shown in conjunction with a multi-poise furnace only by way of illustration, it being understood that the fastening and sealing elements according to the invention may be effectively employed in any inducer or similar device requiring quick and secure assembly of component parts with an air-tight seal therebetween.

The multi-poise condensing furnace 10 includes a burner box 14 having individual burners 16. The individual burners 16 are supplied with gas by a gas manifold 17. The burner box 14 is secured to a cell panel 18 which includes burner target plates 20. Each of the burner target plates 20 includes an inlet port 22 corresponding to the inlet port of individual primary heat exchanger cells 24. The primary heat exchanger cells 24 are contained within a primary heat exchanger 26. Upon assembly, the burner box 14 is secured to the cell panel 18 so that a discharge port 28 of each of the burners 16 is aligned with a corresponding inlet port 22. Gas is supplied to each of the individual burners and is ignited. The products of combustion and heated flue gas exit the individual burners 16 through a respective discharge port 28 and are thereby directed into the primary heat exchanger cells 24. Each of the primary heat exchanger cells 24 terminate at a discharge port 30.

The multi-poise furnace 10 also includes a condensing heat exchanger 32 which includes a number of condensing heat exchangers cells 34. Each of the condensing heat exchanger cells 34 includes an inlet port 36 and a pair of discharge ports 38 as shown in FIG. 1. The discharge ports 30 of the primary heat exchanger 26 are fluidly connected to the inlet ports 36 of the condensing heat exchanger 32 by a coupling box (not shown). A blower 40 is provided in the furnace 10 to move circulating air over the heat exchanger cells 30 and 34. As the circulating air moves over the condensing cells 34, water vapor contained within the fluid gas and products of combustion is condensed within the cells 34 and drains from the cells into a collector box 42. The condensate is then drained away from the collector box from a drain tab 43 into drain piping. The collector box 42 includes a main discharge port 44 as shown in FIG. 2.

Figure 3:
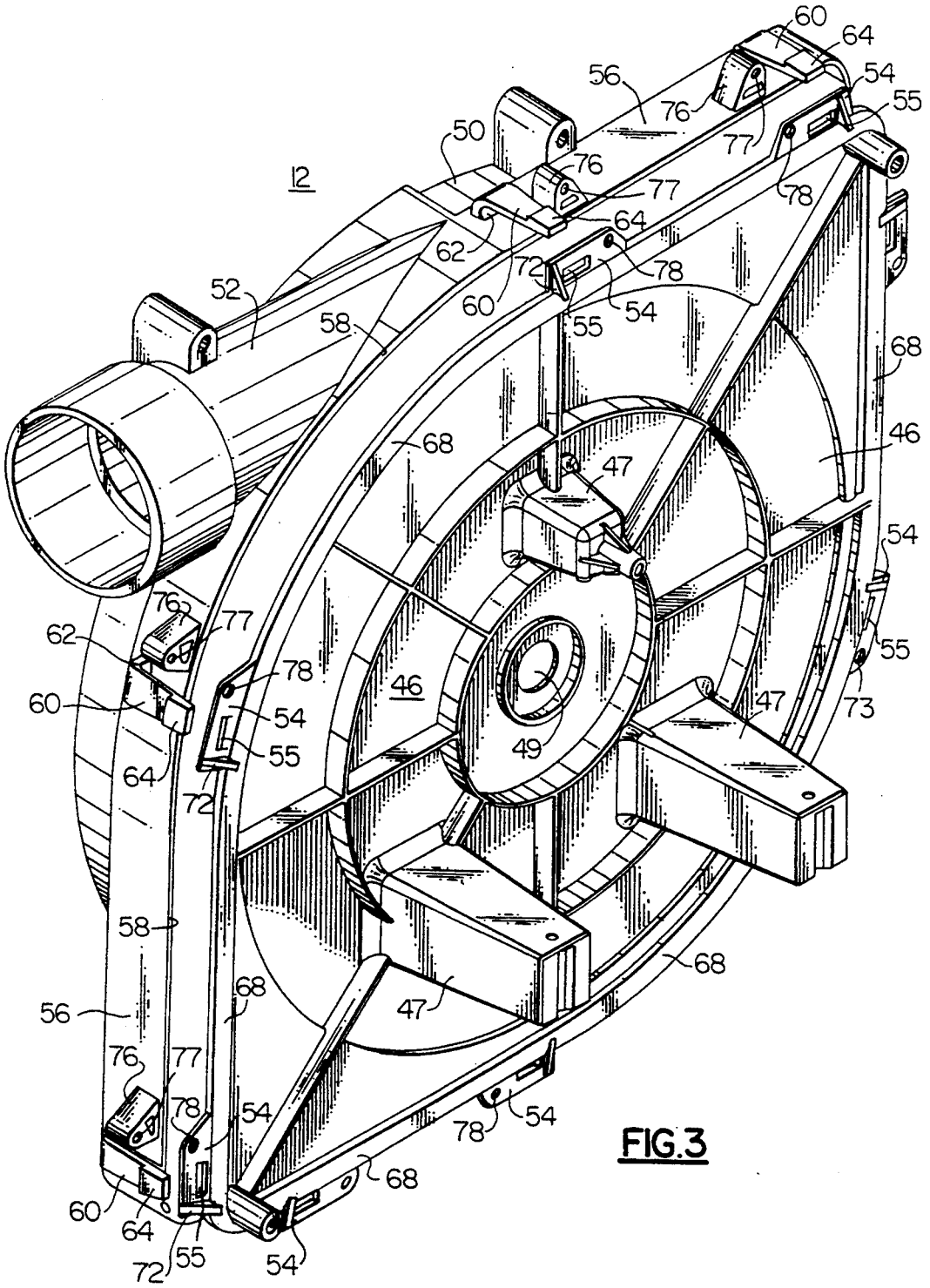
FIG. 3 is an isolated perspective view of the inducer of the present invention.

Referring now to the inducer 12, it is shown in FIGS. 2 and 3 that the inducer includes a cover 46. The exterior side of the cover 46 includes motor mounts 47 for securing a motor 48 thereto. The inducer cover 46 also includes a shaft opening 49, as shown in FIG. 3, to receive a drive shaft provided on the motor. The drive shaft motor passes through the opening 49 to the interior side of the cover 46. Secured on the distal end of the drive shaft is a circular fan (not shown). The inducer 12 also includes a housing 50. The housing 50 includes a large inlet port (not shown) corresponding to the main discharge port 44 of the collector box 42. The inducer housing 50 also includes a pair of discharge ports 52 and 53 in accordance with the multi-poise aspect of the furnace 10. In upflow installation orientation of the multi-poise furnace 10 shown in FIGS. 1 and 2, the discharge port 53 is sealed and capped off while the discharge port 52 is secured to vent piping to vent the flue gas to a location exterior to the structure containing the furnace 10. Prior to combustion of the gas supplied to the burners 16, the inducer motor 48 is activated to be fully operational and ready to move the heated flue gas through the primary heat exchanger cells 24 as well as the condensing heat exchanger cells 32.

Figure 5:
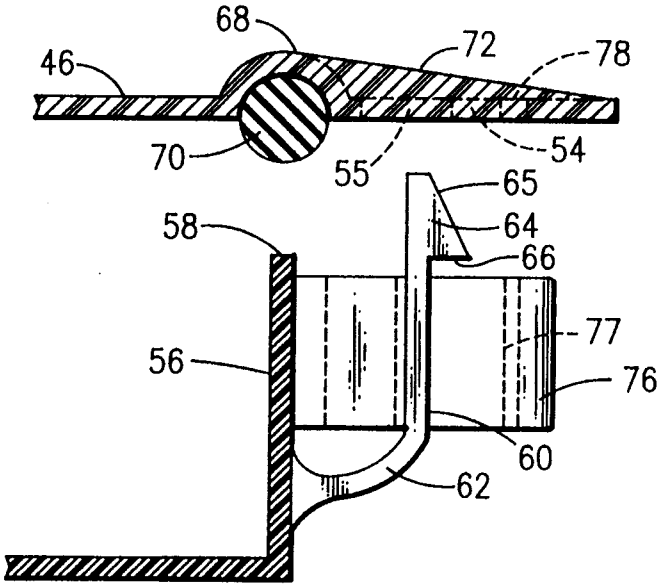
FIG. 5 is a detailed cross sectional view of the present snap-fit inducer fasteners.
Figure 4:
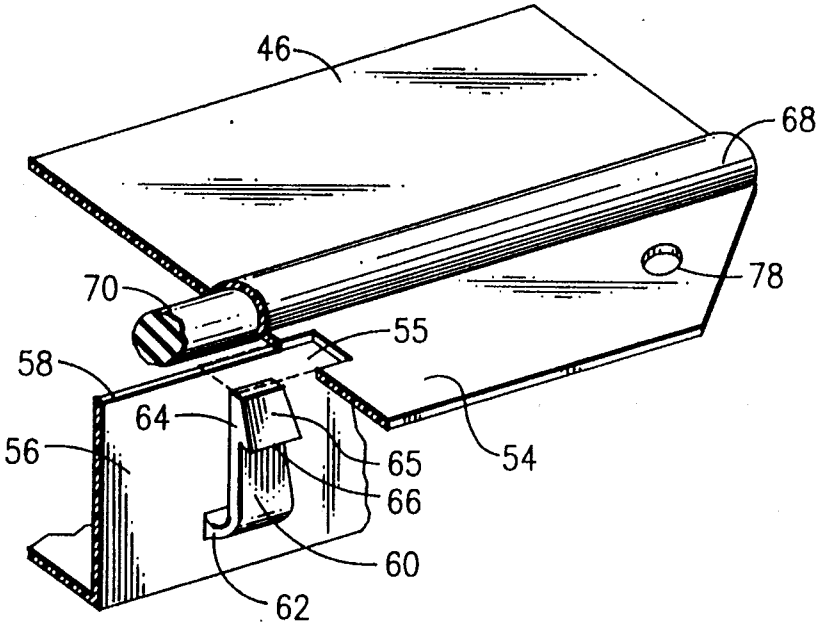
FIG. 4 is a detailed perspective view of the snapfit fasteners according to the present invention.

With reference now to FIGS. 3, 4, and 5, it is shown that the inducer 12 includes a number of outwardly directed tabs 54 positioned around the periphery of the inducer cover 46. Each of the tabs 54 has an aperture 55 formed therein, and is positioned along a radius extending outwardly from the shaft opening 49 as shown in FIG. 3. The inducer housing 50 includes a side wall 56 having a top edge 58. As shown in FIG. 3, the outside of the side wall 56 of the inducer housing 50 incudes a number of flexible arms 60. The number of flexible arms corresponds to the number of outwardly directed tabs 54, and is a function of the overall size of the inducer 12. The exact number of corresponding flexible arms 60 and tabs 54, however, is not considered an aspect of the present invention. Each of the flexible arms 60 includes a shoulder 62 formed at the proximal end thereof, while a barbed detent 64 is formed at the distal end of each of the arms 60. The material forming the inducer housing and cover is preferably a glass filled polycarbonate. The arms 60 are fabricated from the same material as the housing 50 and are formed as an integral structure with the housing by an injection molding process known in the art.

Each of the barbed detents 64 includes a ramp segment 65 which has an incline beginning at the distal end of each of the arms 60 and extending to a retaining face 66 which is perpendicular to the arm 60 as best shown in FIG. 5. An endless channel 68 is formed around the edge of the inducer cover 46 as shown in FIGS. 3, 4 and 5. The channel 68 is formed on the interior side of the cover 46 and protrudes through the cover to the exterior side thereof. A gasket 70, as shown in FIGS. 4 and 5, is positioned within the channel 68. The gasket 70 is preferably of a foam type known in the art. Each tab 54 is also provided with a gusset 72 formed on the exterior side thereof, as shown in FIGS. 3 and 5. Each gusset 72 extends along one end of the tab 54 from a tangent point on the convex side of the endless channel 68 out to the extreme edge of the tab. As represented in FIG. 3, each pair of arms 60 and tabs 54 is shown in conjunction with a boss 76 having a screw hole 77. Each of the tabs 54 is provided with a corresponding screw hole 78. This supplemental manner of securing the cover 46 to the housing 50, i.e., by use of a self-threading screw to secure the tabs 54 to corresponding bosses 76 through screw holes 77 and 78, is illustrated in FIGS. 3 and 5 for purposes of completeness and, while not considered a part of the present invention, is intended to be a part of the preferred embodiment of an inducer in accordance with the invention. The boss 76 functioning as a support for a corresponding tab 54, however, in considered to come within the scope of the present invention.

To assemble the inducer housing 50 with the inducer cover 46 in accordance with the present invention, the cover is positioned with respect to the housing so that the gasket 70 is in contact with the top edge 58 of the side wall 56 of the inducer housing 50. In this condition, a barbed detent 64 will be positioned within a corresponding tab aperture 55. In this pre-assembled condition, a force may be applied against the housing and cover which will cause each of the flexible arms 60 to deflect slightly thus allowing the barbed detent 64 to pass entirely through a corresponding tab aperture 55. At this point, the arm 60 will snap against the aperture 55 with the retaining face 66 binding against the exterior surface of the tab 54 in an area immediately adjacent the aperture 55. Once this assembly is complete, each tab 54 will be positioned in direct contact with a corresponding boss 76. In this manner, the boss 76 gives the tab 54 support to resist bending by the retaining force of the barbed detent 64 exerted against the tab 54. In a similar manner, the gusset 72 also provides the tab 54 continuous support against deflection thereof. In the preferred embodiment, as shown in particular in FIGS. 3 and 5, the gusset 72 is formed on one end of the tab 54 while the corresponding boss 76 is positioned on the housing 50 to coincide with the other end of the tab 54. The positioning of the gusset 72 and the boss 76 at opposite ends of the tab 54 gives the tab added longitudinal stiffness. The injection molding process used to fabricate the present invention allows for precise repeatability of the exact dimensions of the length of each individual arm 60 and the shape of corresponding barbed detents 64. This exact forming enables each of the arms 60 to exert the same force against individual tabs 54 thus creating an even pressure against the gasket 70 around the top edge 58 of the side wall 56.

While this invention has been described in detail with reference to a certain preferred embodiment, it should be appreciated that the present invention is not limited to that precise embodiment. Rather, in view of the present disclosure, many modifications and variations would present themselves to those of skill in the art without departing from the scope and spirit of this invention, as defined in the following claims.

What is claimed is:

1. An inducer for a gas furnace, said inducer of the type having a housing and a cover for the housing, the cover having an interior side and an exterior side for receiving an inducer motor with a drive shaft projectable through the cover to the opposing interior side to receive a fan, the housing having an intake port and a discharge port, the improvement comprising:

fastening means for snapping the housing and cover into a locked condition relative to each other, said fastening means being formed about the periphery of the inducer and including a plurality of flexible arms formed from a resilient material, each of the arms having a shoulder at its proximal end and a barbed detent at its distal end, said plurality of flexible arms being spaced around the periphery of the inducer with the shoulder of each arm integrally formed with the inducer to create a unitary structure;

receiving means for engaging said fastening means, said receiving means being formed about the periphery of the inducer a plurality of outwardly directed tabs spaced around the periphery of the inducer, each of the tabs corresponding to one of said plurality of flexible arms, being formed from a resilient material, and having an aperture for receiving the barb detent of a corresponding flexible arm;

sealing means for creating an air-tight seal between the inducer housing and cover wherein when said fastening means and receiving means are lockingly engaged with each other, an even pressure is exerted on said sealing means;

said inducer housing including a side wall with said plurality of flexible arms being spaced around the outside of the wall; and an outwardly directed boss formed proximate each of said plurality of flexible arms so that when the cover and housing are locked together, each tab is in supporting contact with a corresponding boss.

2. The inducer according to claim 1 wherein each barbed detent includes a ramp segment having an incline beginning at the distal end of its corresponding flexible arm, extending along a predetermined distance toward the shoulder, and terminating with a retaining face being perpendicular to the arm.

3. The inducer according to claim 1 wherein the inducer cover includes said plurality of tabs, each tab directed radially outwardly therefrom to include an interior and an exterior side relative to the cover and said sealing means includes an endless channel formed on the interior side of the cover and extending thereabout to coincide with a top edge of the housing wall, said channel having a gasket positioned therein whereby when the cover is placed on the housing with the gasket in contact with the top edge of the housing wall and each barbed detent is positioned within a corresponding tab aperture, a predetermined force exerted on the housing and cover will cause each flexible arm to bend slightly, each respective detent thereby passing through a corresponding tab aperture until the arm snaps against the edge of the aperture with the retaining face of the detent binding against the exterior side of the tab.

4. The inducer according to claim 3 wherein the material forming the housing and cover is a glass filled polycarbonate.

5. The inducer according to claim 3 further including a gusset formed on the exterior side of each tab being outwardly directed therefrom and adjacent the tab aperture, said gusset stiffening a respective tab so that when the cover and housing are locked together, each tab resists bending under the retaining force exerted thereon by the barbed detent.

6. The inducer according to claim 5 wherein each of said gussets is formed on one end of a corresponding tab and each boss is placed on the housing wall to engage in supporting contact the other end of said corresponding tab.

* * * * *